US008241454B2

(12) United States Patent
Kraus et al.

(10) Patent No.: US 8,241,454 B2
(45) Date of Patent: Aug. 14, 2012

(54) CORRUGATING MACHINE AND METHOD OF PRODUCING CORRUGATED CARDBOARD HAVING A MARKING DEVICE WITH A SOLID COLORING AGENT

(75) Inventors: Helmut Kraus, Wackersdorf (DE); Jürgen Hammer, Weiden (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 409 days.

(21) Appl. No.: 12/137,884

(22) Filed: Jun. 12, 2008

(65) Prior Publication Data

US 2008/0308215 A1 Dec. 18, 2008

(30) Foreign Application Priority Data

Jun. 13, 2007 (DE) ..... 10 2007 027 879

(51) Int. Cl.
*B31F 1/24* (2006.01)

(52) U.S. Cl. ..... 156/205; 156/207; 156/277; 156/470; 156/510; 156/269

(58) Field of Classification Search ..... None
See application file for complete search history.

(56) References Cited

U.S. PATENT DOCUMENTS

| | | | | |
|---|---|---|---|---|
| 1,719,947 | A * | 7/1929 | Swift, Jr. | 156/473 |
| 3,269,178 | A * | 8/1966 | Kohler | 73/159 |
| 3,939,482 | A * | 2/1976 | Cotter | 346/139 C |
| 5,325,306 | A | 6/1994 | Adachi et al. | |
| 5,437,749 | A | 8/1995 | Pipkorn et al. | |
| 5,676,790 | A | 10/1997 | Burrows | |
| 2006/0157512 | A1 * | 7/2006 | van der Heijden | 222/190 |
| 2007/0095451 | A1 * | 5/2007 | Kramp | 156/64 |

FOREIGN PATENT DOCUMENTS

| | | | |
|---|---|---|---|
| DE | 3034212 | A1 | 3/1982 |
| DE | 3800442 | A1 | 3/1989 |
| DE | 4122600 | A1 | 1/1992 |
| DE | 4435212 | A1 | 4/1995 |
| DE | 102005037497 | A1 | 2/2007 |
| GB | 2282464 | A | 4/1995 |
| JP | 56111670 | A * | 9/1981 |
| JP | 2006266981 | A | 10/2006 |

* cited by examiner

*Primary Examiner* — John L. Goff
*Assistant Examiner* — Barbara J Musser
(74) *Attorney, Agent, or Firm* — Browdy and Neimark, PLLC

(57) ABSTRACT

In a corrugating machine and a method of producing corrugated cardboard, provision is made for a marking device by means of which a color mark is applied by rubbing off a solid coloring agent, the color mark being detected by means of a detection device in order to easily and precisely mark and cut out joining points. The applied and detected color mark enables a web length of a web of single-faced corrugated cardboard in a storage device to be determined, thus allowing an electronic control device to operate a cross-cutting device in an easy and precise manner.

9 Claims, 6 Drawing Sheets

CORRUGATING MACHINE AND METHOD OF PRODUCING CORRUGATED CARDBOARD HAVING A MARKING DEVICE WITH A SOLID COLORING AGENT

BACKGROUND OF DISCLOSURE

1. Field of Disclosure

The invention concerns a corrugating machine and a method of producing corrugated cardboard.

2. Background Art

For producing continuous webs of material, conventional corrugating machines have several splicing devices, each of which joining a plurality of discontinuous webs of material to form a continuous web of material. In technical language, joining the discontinuous webs of material to form a continuous web of material is referred to as splicing, the devices required therefor thus being referred to as splicing devices. The splicing procedure causes joining points—so-called splices—to form between the discontinuous webs of material of the continuous webs of material. The joining points of the continuous webs of material are visible in the corrugated cardboard upon production thereof and must be cut out for quality reasons by means of a cross-cutting device. In order to precisely cut out the joining points, the cross-cutting device must be able to locate the positions of the joining points in the webs of corrugated cardboard which is quite problematic as storage devices are disposed in the corrugating machine for temporarily storing the web of corrugated cardboard during the production process; consequently, the length of the temporarily stored web of corrugated cardboard is not precisely known.

U.S. Pat. No. 5,676,790 teaches to spray a liquid, such as water, onto the web of corrugated cardboard by means of a spraying device before temporarily storing the corrugated cardboard, thereby causing a spot to form on the web of corrugated cardboard. This spot is detected by means of a thermal detector after temporary storage of the web of corrugated cardboard such that the length of the temporarily stored web of corrugated cardboard may be determined in dependence of the runtime of the spot and other known system parameters. A drawback thereof is, however, that spraying on the liquid requires provision of complex machinery and elaborate procedures.

SUMMARY OF DISCLOSURE

It is the object of the invention to create a corrugating machine and a method of producing corrugated cardboard which allow for easy and precise removal of joining points present in the web of corrugated cardboard.

This object is attained by a corrugating machine for producing corrugated cardboard, the corrugating machine comprising at least three splicing devices for providing at least three continuous webs of material; at least one corrugating device for producing at least one corrugated web from at least one of the webs of material; at least one first production device for joining the at least one corrugated web to at least another web of material to form at least one web of single-faced corrugated cardboard; at least one second production device for joining the at least one web of single-faced corrugated cardboard to at least another web of material to form at least one web of double-faced corrugated cardboard; at least one storage device for temporarily storing the at least one web of single-faced corrugated cardboard, the storage device being disposed between the production devices; at least one marking device for applying at least one color mark to at least one of the webs, the marking device being disposed upstream of the at least one storage device when seen in a transport direction, wherein the at least one marking device is designed such that a coloring agent is applicable to create a color mark, the coloring agent being present in solid form; at least one detection device for detecting the at least one color mark, the detection device being disposed downstream of the at least one storage device when seen in the transport direction; at least one electronic control device for determining a web length of the at least one temporarily stored web of corrugated cardboard by means of the at least one applied and detected color mark; and at least one cross-cutting device for cutting the at least one web of double-faced corrugated cardboard in dependence of the determined web length; and by a method of producing corrugated cardboard comprising the following steps: providing at least three continuous webs of material by means of at least three splicing devices; producing at least one corrugated web from at least one of the webs of material by means of at least one corrugating device; joining the at least one corrugated web to at least another web of material to form at least one web of single-faced corrugated cardboard by means of at least one first production device; applying at least one color mark to at least one of the webs by means of at least one marking device, the at least one color marking being applied by rubbing off a coloring agent which is present in solid form; temporarily storing the at least one marked web of corrugated cardboard by means of at least one storage device; detecting the at least one color mark at least after temporary storage by means of at least one detection device; determining a web length of the at least one temporarily stored web of corrugated cardboard by means of the at least one applied and detected color mark in at least one electronic control device; joining the at least one web of single-faced corrugated cardboard to at least another web of material to form at least one web of double-faced corrugated cardboard by means of at least one second production device; and cutting the at least one web of double-faced corrugated cardboard in dependence of the determined web length by means of at least one cross-cutting device. The essence of the invention is that at least one marking device is disposed upstream of the at least one storage device, the marking device being used to apply at least one color mark to one of the webs of the corrugated cardboard. The at least one marking device is designed such that a coloring agent, which is present in solid form, is applicable to create a color mark. The color mark is applied by rubbing off the solid coloring agent. Since the coloring agent is solid and is applicable as such, there is no need for complex and high-maintenance spraying means as they are required for example if the coloring agent is present in liquid form. The coloring agent may for example be a marking chalk, a pastel chalk or an oil chalk. Since the at least one color mark is applied by means of a solid coloring agent, the webs of material are not subject to humidity causing them to soften in a disadvantageous manner, as it is the case with liquids. The at least one color mark is detectable by means of the at least one detection device, thus ensuring that the length of the web of temporarily stored corrugated cardboard may be determined by the at least one control device by means of the detected color mark. Depending on the determined web length, the at least one cross-cutting device is operable such that the web of corrugated cardboard may be precisely cut, allowing joining points to be precisely removed. Thus, it is no longer necessary to provide a liquid and to apply this liquid by means of a complex spraying device.

Further features and details of the invention will become apparent from the description of an embodiment by means of the drawing.

DETAILED DISCLOSURE

Figure 1:
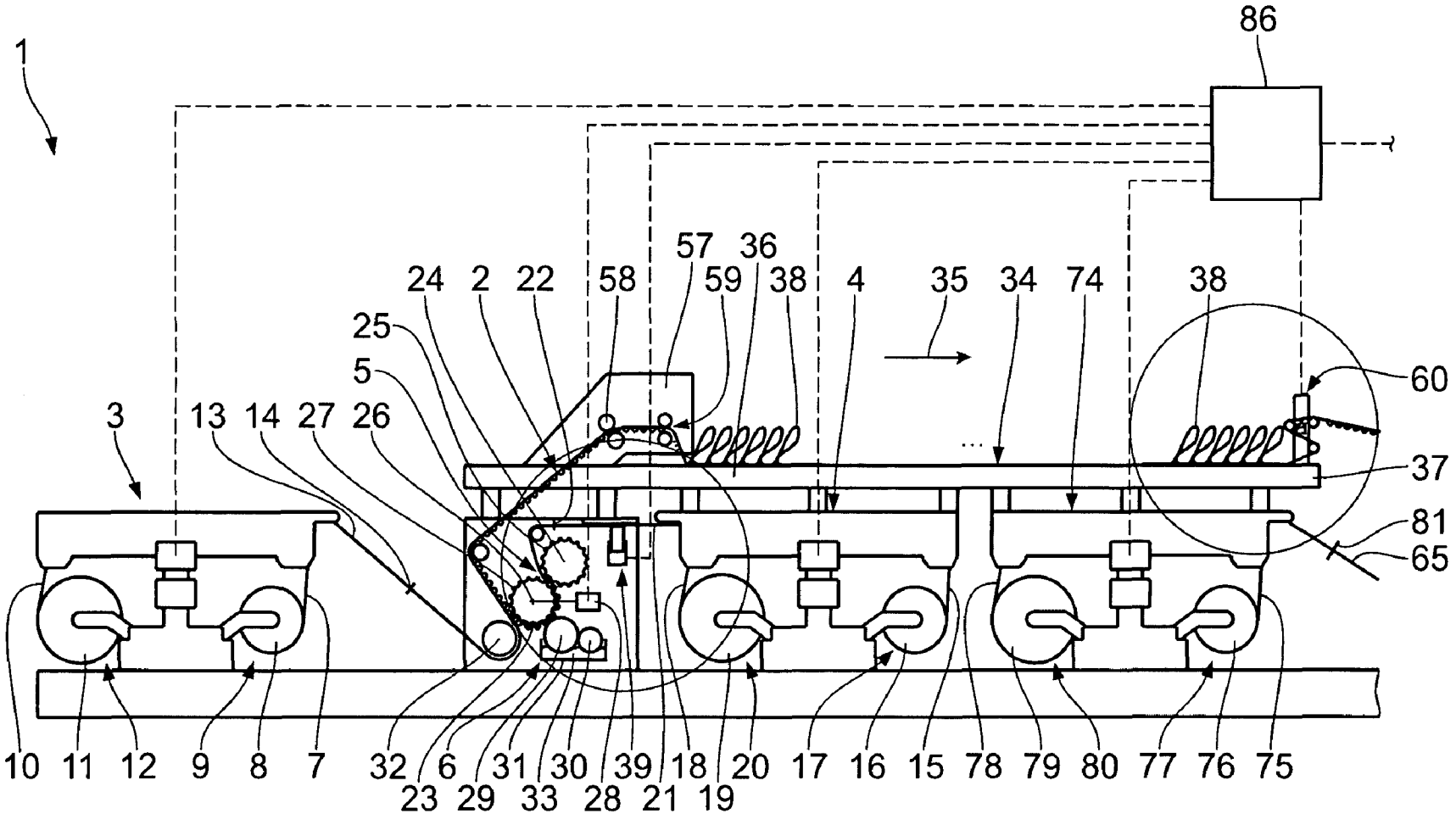
FIG. 1 shows a first part of a corrugating machine.

In order to produce a web of single-faced corrugated cardboard 2, a corrugating machine 1 has a first splicing device 3, a second splicing device 4, a corrugating device 5 and a first production device 6. The first splicing device 3 has a first unrolling unit 9 for unrolling a discontinuous first web of material 7 from a first roll of material 8, and a second unrolling unit 12 for unrolling a discontinuous second web of material 10 from a second roll of material 11. The discontinuous first and second webs of material 7, 10 are spliced together by means of a splicing and cutting unit (not shown) of the first splicing device 3 to form a continuous first web of material 13. Each time discontinuous webs of material 7, 10 are spliced together, a first joining point 14 is produced in the continuous web of material 13, the first joining point 14 extending transversely relative to the continuous first web of material 13. FIG. 1 shows an exemplary first joining point 14 between the first splicing device 3 and the first production device 6.

The second splicing device 4 is designed according to the first splicing device 3, comprising a third unrolling unit 17 for unrolling a discontinuous third web of material 15 from a third roll of material 16 and a fourth unrolling unit 20 for unrolling a discontinuous fourth web of material 18 from a fourth roll of material 19. The discontinuous third and fourth webs of material 15, 18 are spliced together by means of a splicing and cutting unit (not shown) of the second splicing device 4 to form a continuous second web of material 21. Each time discontinuous webs of material 15, 18 are spliced together, a second joining point 22 is produced in the continuous second web of material 21, the second joining point 22 extending transversely to the continuous second web of material 21. An exemplary second joining point 22 is shown between the second splicing device 4 and the corrugating device 5.

The continuous webs of material 13, 21 used in the production of corrugated cardboard are continuous paper webs, the joining points 14, 22 therein being referred to as splices in technical language.

The continuous second web of material 21 is supplied to the corrugating device 5. In order to produce a continuous corrugated web 23 from the continuous second web of material 21, the corrugating device 5 has a first corrugating roller 25 that is mounted for rotation about a first axis of rotation 24, and a second corrugating roller 27 that is mounted for rotation about a second axis of rotation 26. The corrugating rollers 25, 27 form a gap through which the continuous second web of material 21 may be passed to be corrugated, the axes of rotation 24, 26 being parallel to each other. A measuring device 28 is disposed at the second corrugating roller 27 for measuring the rotational speed of the second corrugating roller 27.

The first production device 6 has a first adhesive-applicator roller 29, a first adhesive-dosing roller 30, a first adhesive container 31 and a first pressure roller 32 for joining the corrugated web 23 to the continuous first web of material 13 to form the web of single-faced corrugated cardboard 2. A coating of adhesive is applied to the corrugated web as it passes through a gap formed between the first adhesive-applicator roller 29 and the second corrugating roller 27, wherein the first adhesive-applicator roller 29 is partially disposed in the first adhesive container 31 for applying adhesive 33. Bearing against the first adhesive-applicator roller 29, the first adhesive-dosing roller 30 serves to form a uniform coating of adhesive on the first adhesive-applicator roller 29. The first pressure roller 32 forms a gap with the second corrugating roller 27 for pressing the corrugated web 23 coated with adhesive 33 against the continuous first web of material 13, the continuous first web of material 13 and the corrugated web 23 simultaneously passing through said gap.

The web of single-faced corrugated cardboard 2 is supplied to a storage device 34 in which it is temporarily stored and buffered, the web of single-faced corrugated cardboard 2 having a transport direction 35 in the storage device 34. In the storage device 34, the web of single-faced corrugated cardboard 2 is transported in the transport direction 35 from a storage-device entry side 36 to a storage-device exit side 37, the web of single-faced corrugated cardboard 2 forming loops 38 in the storage device 34. The temporarily stored, web of single-faced corrugated cardboard 2 has a web length $L_B$ between the storage-device entry side 36 and the storage-device exit side 37, the web length $L_B$ depending on the length of the storage device 34 and the number of loops 38. The storage device 34 has the shape of a table and is referred to as bridge in technical language.

Relative to the transport direction 35, a marking device 39 is disposed up-stream of the storage device 34. The marking device 39 is used to apply color marks 40 to the continuous webs of material 21. The marking device 39 is disposed between the second splicing device 4 and the corrugating device 5, thus ensuring that the color marks 40 are applicable to an under-side of the continuous second web of material 21 to be corrugated. Most appropriately, the color marks 40 are applied prior to gluing in the production device 6, i.e. also in the splicing device 4, for example, or even before that by marking the roll of material.

The marking device 39 is designed such that a coloring agent 41, which is present in solid form as a cylindrical bar, is applicable to create a color mark 40. The coloring agent 41 is for example composed of solid marking chalk, solid pastel chalk, solid oil chalk or similar solid materials which are suitable for the creation of color marks 40. The marking device 39 is a piston-cyclinder unit having a cylinder 42 in the shape of a tubular housing and a piston 44 that is displaceable in the cylinder 42 along a direction of displacement 43. The piston 44 is joined to a holder 45 which receives a coloring agent 41 that is present in solid form as a chalk block. The chalk block is in particular glued to the holder 45. The cylinder 42 has a first cylinder opening 46 at its front end, the cylinder opening 46 being formed such that when the coloring agent 41 is displaced, the coloring agent 41 may pass through the first cylinder opening 46 through a plastic guide ring 87. A monitoring device 47 in the form of an inductive proximity switch is disposed in the cylinder 42 near the first cylinder opening 46 for monitoring the level of coloring agent 41. Opposite the first cylinder opening 46, the cylinder 42 has a second cylinder opening 48. The second cylinder opening 48 is sealed tightly by a cylinder lid 49. The piston 44 allows mounting of several annular return elements 52 comprising return lips 53, the return elements 52 being disposed on the piston 44. The following is a detailed description of the design of the piston 44: The plate-shaped holder 45 is screwed to a support plate 88 by means of screws 89. The support plate 88 has a central bore 90 with an internal thread. In a direction opposite to direction 43, the annular return lips 53 and support disks 91 are disposed downstream of the support plate 88, wherein in the present example, three pairs of each are alternately disposed next to the support plate 88. The block comprising disks 91 and return lips 53 is held together by a central screw 92 which is screwed into the support plate 88 for holding together the piston 44.

The cylinder 42, the piston 44 and the lid 49 substantially define a pressure chamber 54 which may be filled with a fluid, such as compressed air, via a valve 93 in the lid 49.

The marking device 39 is disposed relative to the continuous second web of material 21 such that the direction of displacement 43 is substantially perpendicular to a plane spanned by the continuous second web of material 21 in the vicinity of the marking device 39. Opposite the marking device 39, a support component 55 is disposed relative to the continuous second web of material 21. The support component 55 has the shape of a plate. Alternatively, the support component 55 may also be a roller mounted for rotation. The marking device 39 is electrically-pneumatically operable, wherein an electrically operable compressed-air pump is provided for displacing the piston 44, the pump being provided for filling the pressure chamber 54 with compressed air. The marking device 39 is disposed relative to the continuous second web of material 21 such that the latter is markable in an edge area 56.

Feed rollers 58 are disposed in pairs along an extension 57 of the storage device 34 for storing the web of single-faced corrugated cardboard 2 in the storage device, with two feed rollers 58 at a time forming a guide gap 59 through which the web of single-faced corrugated cardboard 2 is supplied to the storage device 34.

A detection device 60 for detecting the color marks 40 is disposed down-stream of the storage device 34 in the transport direction 35, the detection device 60 being disposed between the storage device 34 and a second production device 61. Another detection device 60 may be provided between the first production device 6 and the storage device 34.

The detection device 60 has an optical detector 62 which is disposed on a detector carrier 63. The detector carrier 63 is fastened to the storage device 34 and extends substantially transversely thereto. Several deflection rollers 64 are mounted for rotation on the detector carrier 63 for deflecting the web of single-faced corrugated cardboard 2. The deflection rollers 64 are disposed on the detector carrier 63 such that the web of single-faced corrugated cardboard 2 with the color marks 40 may be guided along the detector 62 in a substantially horizontal manner.

The second production device 61 serves to join the web of single-faced corrugated cardboard 2 to a continuous third web of material 65 serving as liner sheet so as to form a web of double-faced corrugated cardboard 66.

For applying adhesive 33 to the corrugated web 23 of the web of single-faced corrugated cardboard 2, the second production device 61 has a second adhesive-applicator roller 67, a second adhesive-dosing roller 68 and a second adhesive container 69. A heatable pressing table 70 and a continuous pressing belt 71 are provided for pressing the continuous third web of material 65 onto the web of single-faced corrugated cardboard 2 covered with adhesive 33, the pressing table 70 and the pressing belt 71 forming a pressing gap 72. The pressing belt 71 is deflected via three belt-deflection rollers 73 and is drivable.

A third splicing device 74 is intended for producing the continuous third web of material 65. The third splicing device 74 is designed according to the splicing devices 3, 4, having a fifth unrolling unit 77 for unrolling a discontinuous fifth web of material 75 from a fifth roll of material 76 and a sixth unrolling unit 80 for unrolling a discontinuous sixth web of material 78 from a sixth roll of material 79. The third splicing device 74 furthermore has a splicing and cutting unit (not shown) by means of which the discontinuous webs of material 75, 78 may be spliced together to form the continuous third web of material 65. Each time discontinuous webs of material 75, 78 are spliced together, a third splice 81 is produced. FIG. 1 shows an exemplary third splice 81 disposed downstream of the third splicing device 74. Likewise, the continuous third web of material 65 is also a continuous paper web.

A cross-cutting device 82 is intended for cutting the web of double-faced corrugated cardboard 66. The cross-cutting device 82 has two cross-cutting rollers 83, each of which having a knife bar 84 which extends radially out-wards and transversely to the web of double-faced corrugated cardboard 66. The cross-cutting rollers 83 form a cutting gap 85 through which the web of double-faced corrugated cardboard 66 may pass, the cross-cutting rollers 83 being drivable for rotation.

Figure 2:
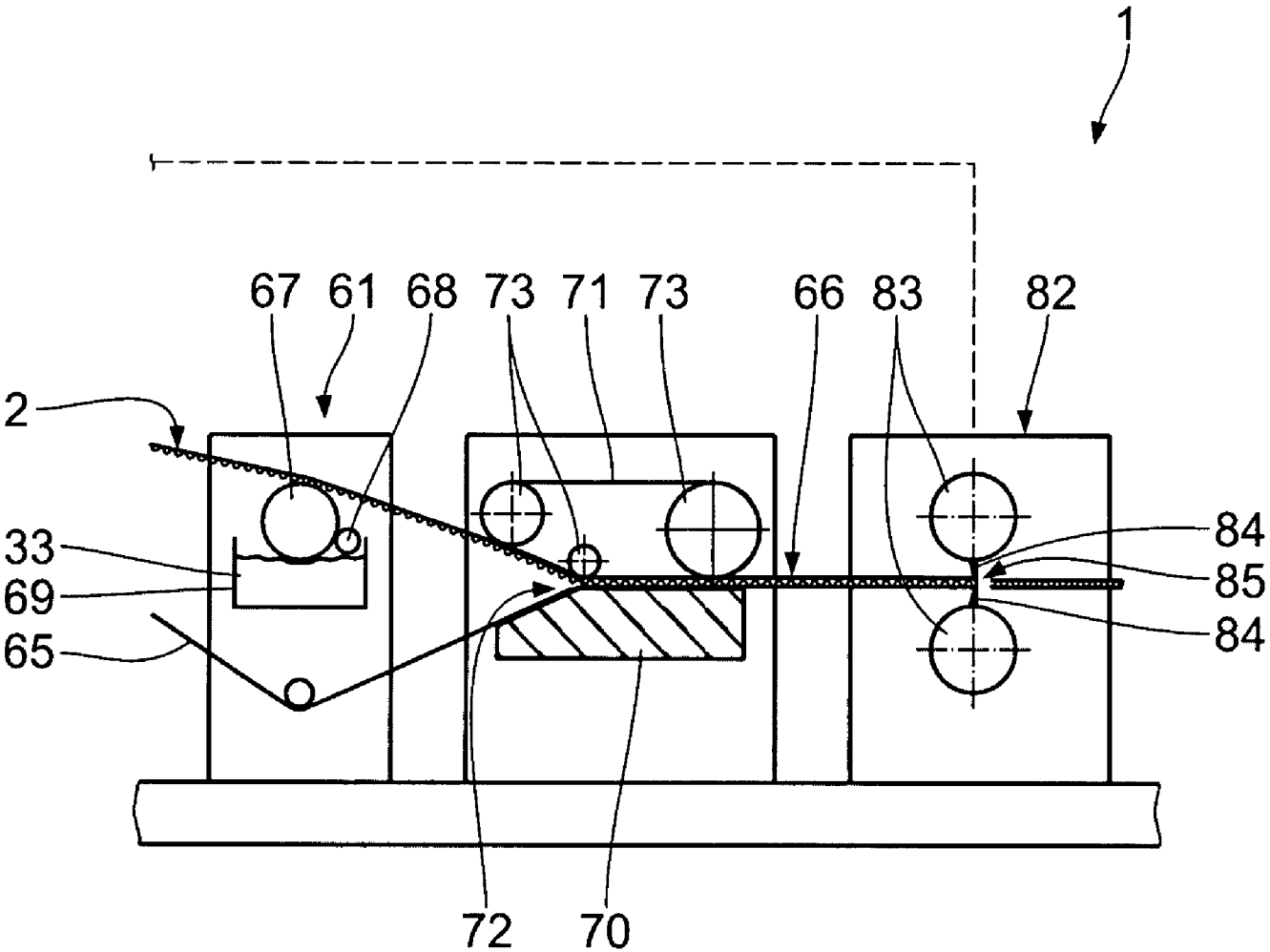
FIG. 2 shows a second part of the corrugating machine.
Figure 3:
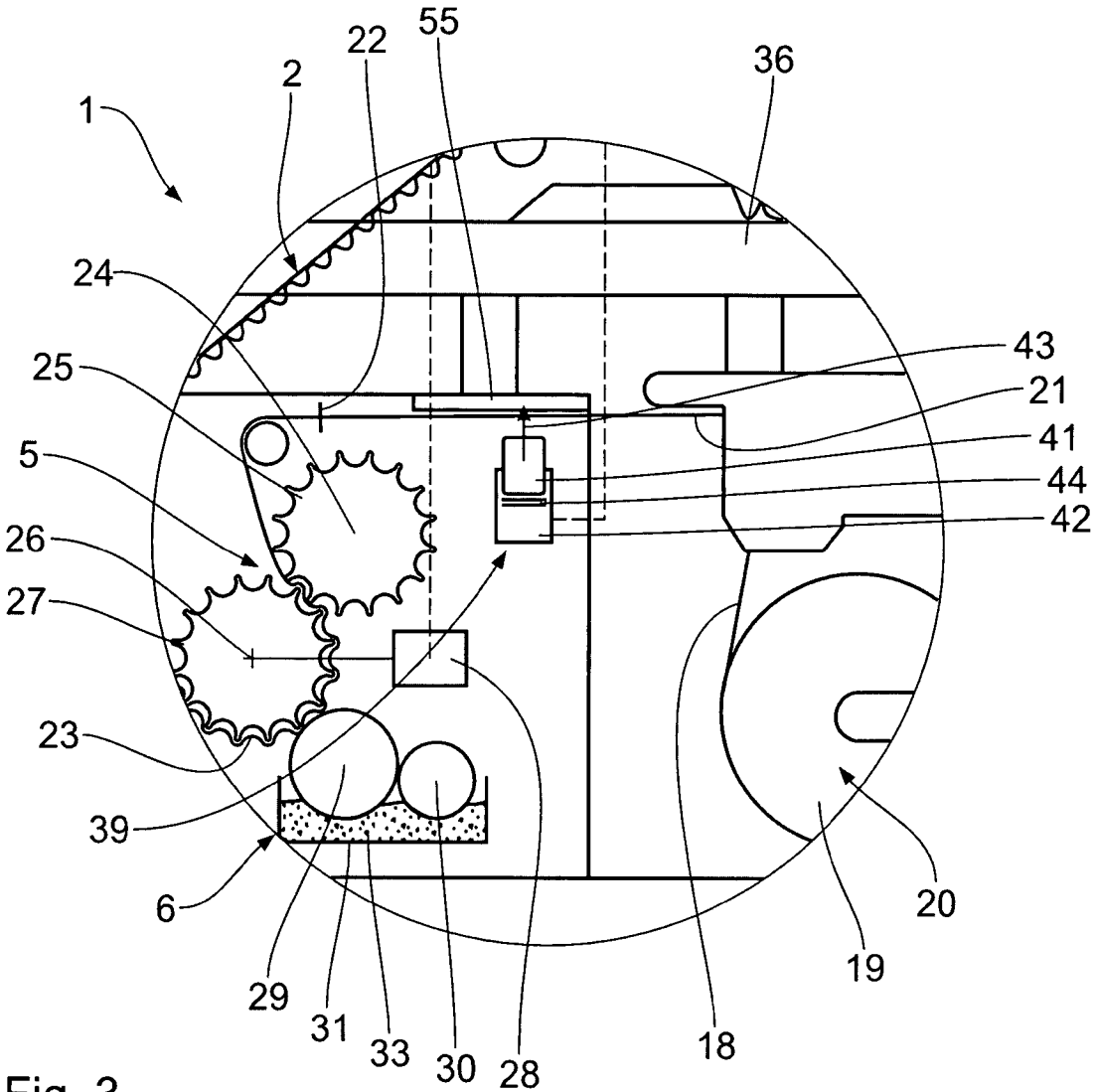
FIG. 3 shows an enlarged section of the corrugating machine according to FIG. 1 in the vicinity of a marking device.
Figure 4:
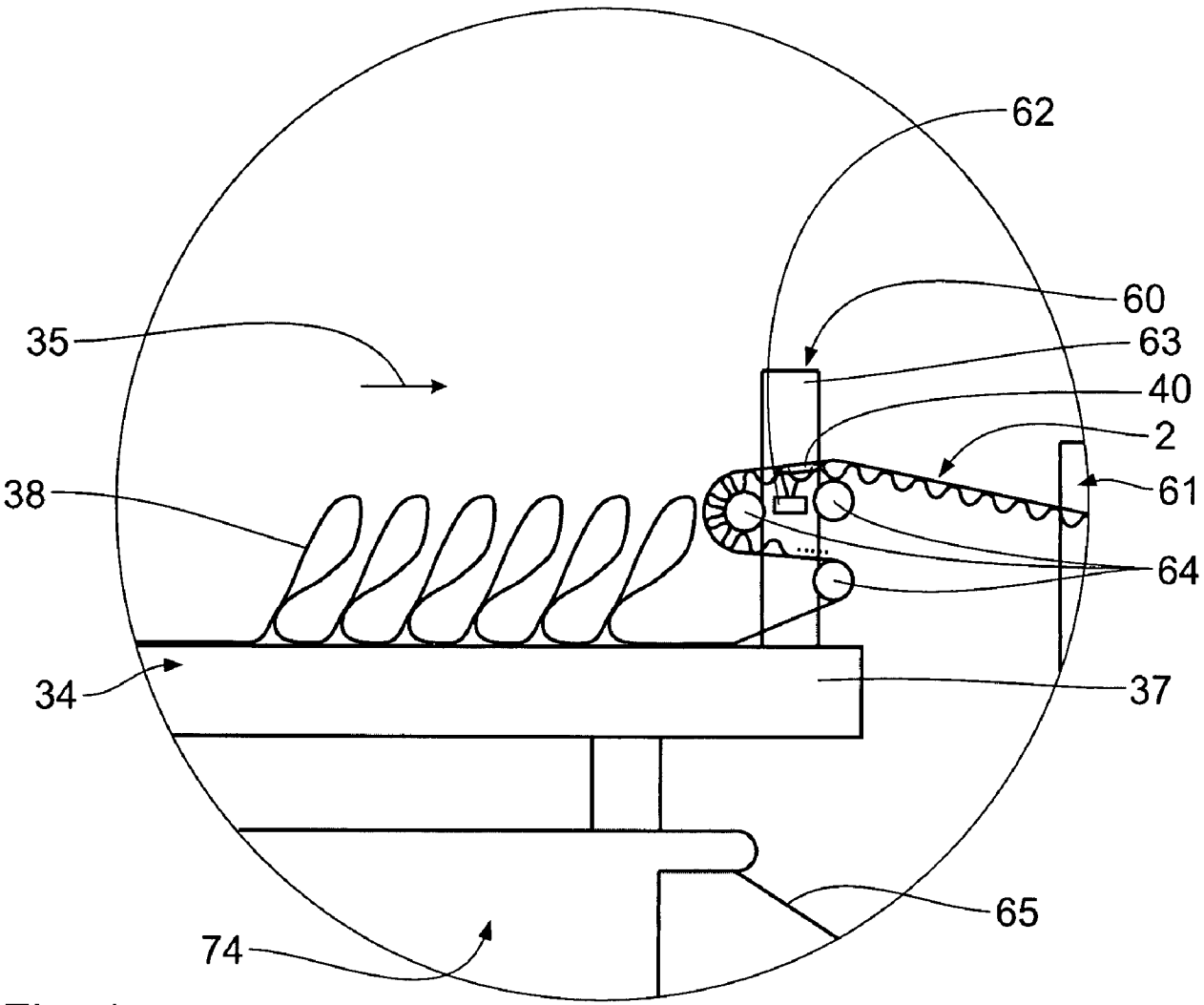
FIG. 4 shows an enlarged section of the corrugating machine according to FIG. 1 in the vicinity of a detection device.
Figure 5:
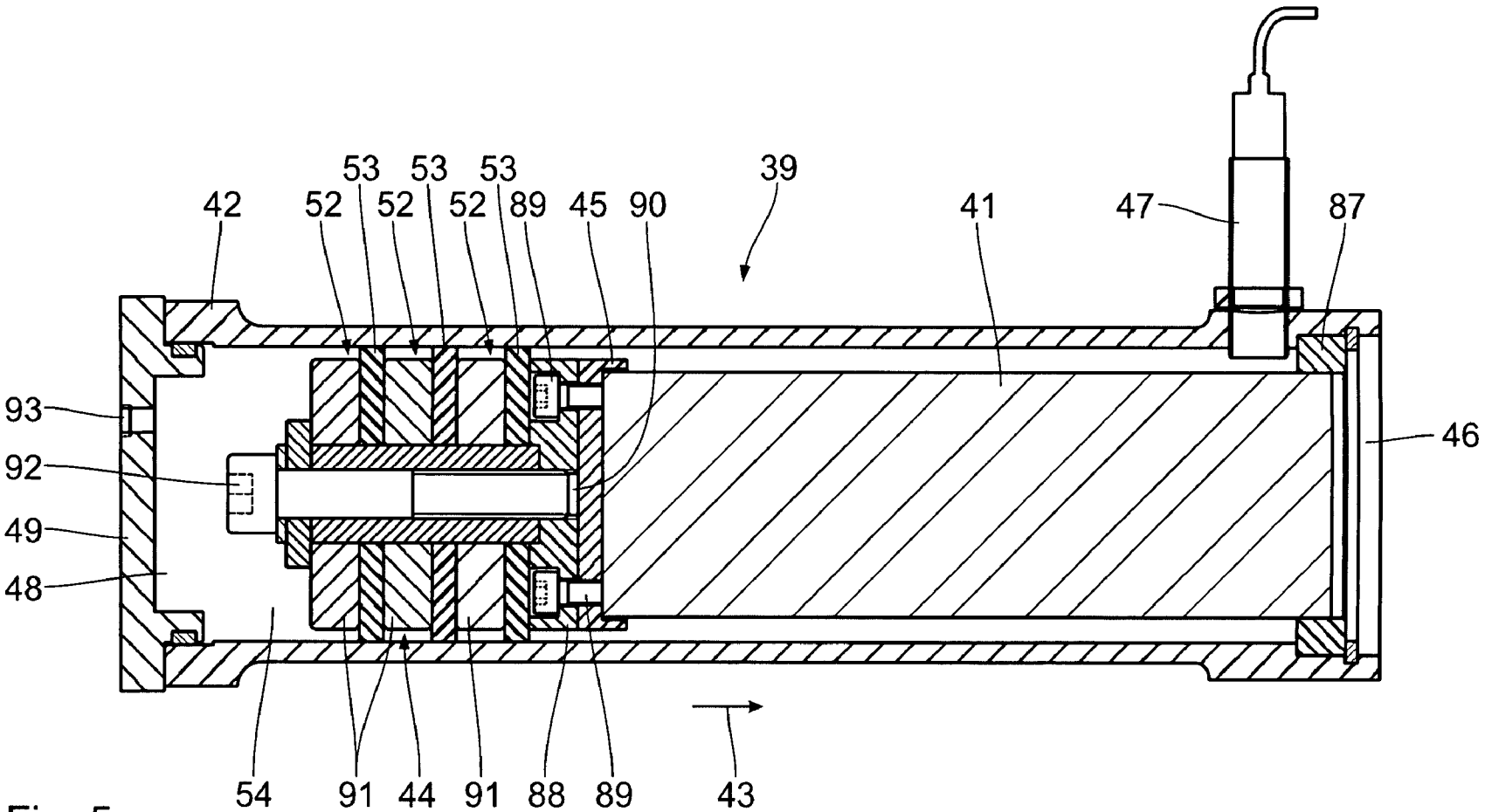
FIG. 5 shows a cut through the marking device according to FIG. 3.

An electronic control device 86 is intended for controlling the corrugating machine 1, the electronic control device 86 being in a signal connection with the splicing devices 3, 4, 74, with the measuring device 28, with the marking device 39, with the detection device 60 and with the cross-cutting device 82. In FIGS. 1 and 2, the signal connections are shown by dashed lines. The splicing devices 3, 4, 74 provide information to the control device 86 such that the control device 86 knows the point of time when discontinuous webs of material 7, 10, 15, 18, 75, 78 are spliced together and, consequently, splices 14, 22, 81 are produced. Furthermore, the control device 86 is designed such that the web length $L_B$ of the web of single-faced corrugated cardboard 2, which is temporarily stored in the storage device 34, may be determined by means of measuring values generated by the measuring device 28 and by means of control signals generated by the marking device 39 and the detection device 60 when marking and detecting color marks 40. The cross-cutting device 82 is operable by means of the control device 86 depending on the determined web length $L_B$.

A conventional longitudinal cutting/corrugating device may be disposed upstream or downstream of the cross-cutting device 82. Moreover, further cutting devices for cutting sheets of corrugated cardboard and stacking devices for stacking the sheets of corrugated cardboard may be disposed downstream of the cross-cutting device 82.

The following is a description of the functioning of the corrugating machine 1. The first splicing device 3 produces the continuous first web of material 13 which is supplied to the first production device 6. The continuous first web of material 13 is for example produced such that the discontinuous first web of material 7 of the running out first roll of material 8 is spliced onto the second discontinuous web of material 10 of the second new roll of material 11. When the splicing process is complete, the first unrolling unit 9 is equipped with a new first roll of material 8, thus ensuring that the discontinuous webs of material 7, 10 may continuously be spliced together to form the first continuous web of material 13. Each time webs of material 7, 10 are spliced together, the first splicing device 3 transmits a signal to the control device 86 so as to inform the latter when a first splice 14 is produced. In analogy to the first splicing device 3, the second splicing device 4 produces the continuous second web of material 21 from the discontinuous webs of material 15, 18. Each time webs of material 15, 18 are spliced together, the second splicing device 4 transmits a signal to the control device 86 so as to inform the latter when a second splice 22 is produced.

Figure 6:
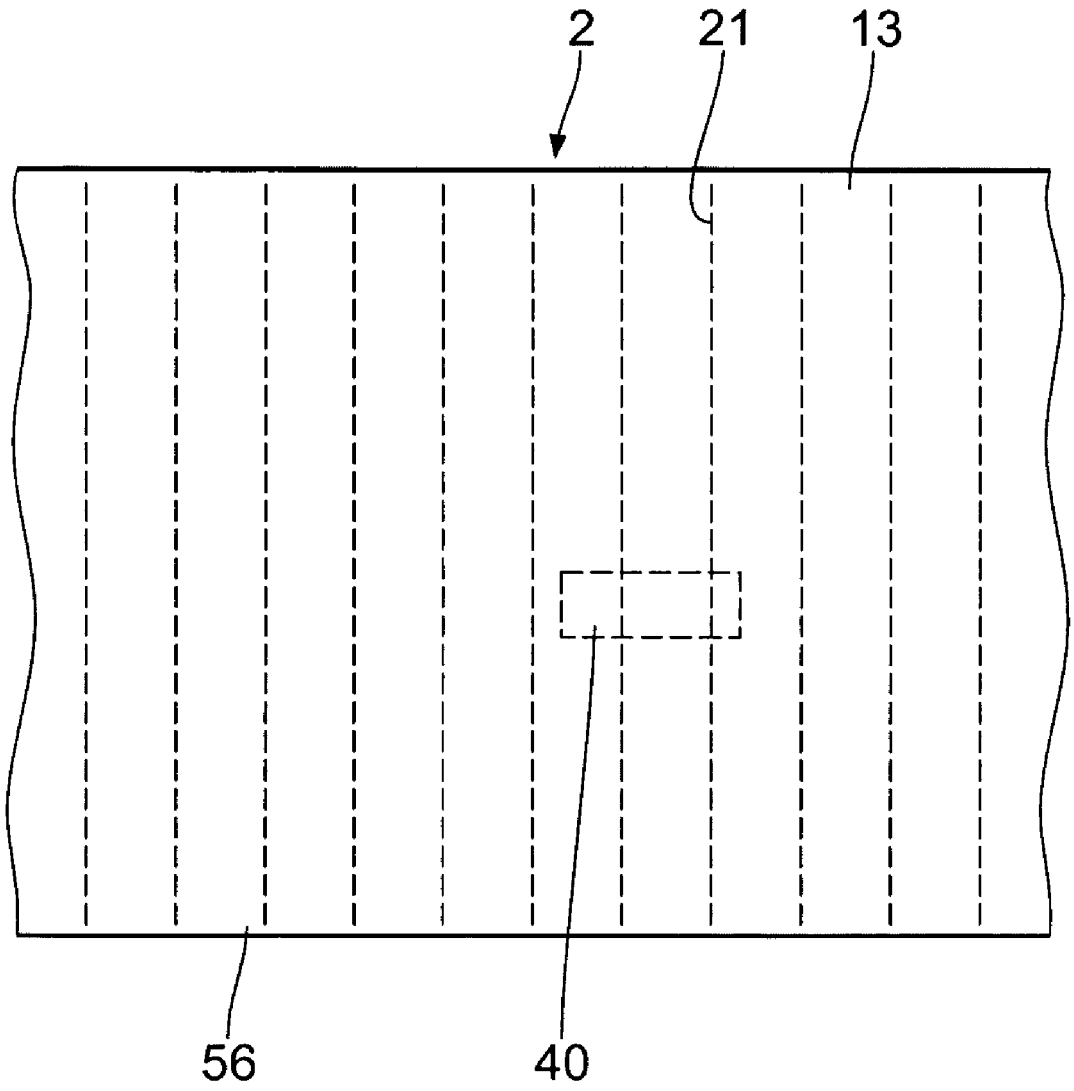
FIG. 6 shows a sectional plane view of a web of corrugated cardboard marked by means of the marking device according to FIG. 3.

The continuous second web of material 21 to be corrugated is supplied to the marking device 39. In order to mark the continuous second web of material 21 with a color mark 40, the pressure chamber 54 is acted upon with compressed air by means of the compressed-air pump which is electrically operated by the control device 86. The compressed air causes the piston 44 to move in the direction of displacement 43, thus causing the solid coloring agent 41 to be moved out of the cylinder 42 through the first cylinder opening 46. When moving out of the cylinder 42, the coloring agent 41 is pressed against the continuous second web of material 21, which is in turn pressed against the support component 55. The continuous second web of material 21 passing through between the coloring agent 41 and the support component 55 is marked by rubbing off the coloring agent 41, thereby creating a color mark 40. FIG. 6 shows a color mark 40. This color mark 40 may be created in the center or at the edge of the continuous second web of material 21. The length of the color mark 40 depends on the speed of the continuous second web of material 21 and the duration of the pressing process. Due to their inherent elasticity and owing to friction against the inner cylinder wall, the return lips 53 of the return elements 52 automatically retract the piston 44 and the coloring agent 41 into the cylinder 42, e.g. by 2 to 4 mm, as soon as the pressure in the chamber 54 is reduced.

It is not necessary for the control device 86 to operate the compressed-air pump in order to retract the coloring agent 41. The monitoring device 47 continuously monitors the amount of coloring agent 41 available for marking. If the amount of coloring agent 41 is too low, the monitoring device 47 transmits a message to the control device 86. During the marking process, the marking device 39 transmits a signal to the control device 86. The color mark 40 is advantageously applied in the area upstream of the splices 14, 22. The support component 55 may alternatively also be designed as a counter shaft mounted for rotation.

The marked continuous second web of material 21 is supplied to the corrugating device 5, the corrugating device 5 producing the corrugated web 23 from the continuous second web of material 21. In the first production device 6, the corrugated web 23 is covered with adhesive 33 and glued to the continuous first web of material 13 to form the web of single-faced corrugated cardboard 2, the first web of material 13 serving as liner sheet. The measuring device 28 measures the rotational speed of the second corrugating roller 27 and transmits the measures speed values to the control device 86. By means of the splicing devices 3, 4, the splices 14, 22 are produced such that they are disposed one above the other in the web of single-faced corrugated cardboard 2 in a substantially congruent manner. The known web lengths between the first splicing device and the first production device 6 and between the second splicing device 4 and the first production device 6 enable the splicing devices 3, 4 to be operated for synchronization of the splices 14, 22.

After the color mark 40 has been applied to the continuous second web of material 2, the web of single-faced corrugated cardboard 2 is supplied to the storage device 34 where it is temporarily stored in loops 38 so as to form a buffer. The web of single-faced corrugated cardboard 2 is transported in the transport direction 35 from the storage-device entry side 36 to the storage-device exit side 37 where it is supplied to the detection device 60.

In the detection device 60, the applied color mark 40 is detected by means of the optical detector 62, an electric signal being transmitted to the control device 86 during the detection process. The time intervals between the electric signals that are generated when the color mark 40 is applied and detected and the measured rotational speed of the second corrugating roller 27 enable the control device 86 to calculate the web length $L_B$ of the temporarily stored web of single-faced corrugated cardboard 2. Alternatively, the described marking and detecting process may be repeated periodically so that color marks 40 are continuously applied and detected, thus ensuring that a calculation of the web length $L_B$ may be repeated in short intervals. The current web length $L_B$ is thus known at all times. Alternatively, another electric signal may be generated by means of another detection device 60 that is disposed downstream of the first production device 6 in the area upstream of the storage-device entry side 36, the electric signal being transmitted to the storage device 86 where it is used together with the electric signal of the detection device 60 that is disposed at the storage-device exit side 37 in order to calculate the web length $L_B$.

The detection device 60 is a grayscale sensor which optically senses and detects the color mark 40 due to its color contrast with respect to the continuous second web of material 21.

After the color mark 40 has been detected, the web of single-faced corrugated cardboard 2 is supplied to the second production device 61. In the second production device 61, the corrugated web 23 of the web of single-faced corrugated cardboard 2 is covered with adhesive 33 and joined to the continuous third web of material 65 by means of the pressing table 70 and the pressing belt 71 to form the web of double-faced corrugated cardboard 66, the third web of material 65 serving as liner sheet.

The continuous third web of material 65 is created by the third splicing device 74 in which the continuous third web of material 65 is produced by splicing together the discontinuous webs of material 75, 78. With respect to the function of the third splicing device 74, reference is made to the function of the first and second splicing devices 3, 4. Each time webs of material 75, 78 are spliced together, the third splicing device 74 transmits an electric signal to the control device 86 so as to inform the latter when a third splice 81 is produced. Depending on the determined web length $L_B$ and the measured rotational speed values, the control device 86 operates the third splicing device 74 such that the third splice 81 of the continuous third web of material 65 and the splices 14, 22 of the webs of material 13, 21 that are spliced together to form the web of single-faced corrugated cardboard 2 are disposed one above the other in a congruent manner in the web of double-faced corrugated cardboard 66. By means of the control device 86, the splices 14, 22, 81 are thus synchronized in dependence of the determined web length $L_B$.

The web of double-faced corrugated cardboard 66 is supplied to the cross-cutting device 82, the cross-cutting device 82 being operated by the control device 86 such as to cut out the splices 14, 22, 81 present in the web of double-faced corrugated cardboard 66. Synchronizing the splices 14, 22, 81 in dependence of the determined web length $L_B$ ensures easy operation of the cross-cutting device; owing to the synchronized splices 14, 22, 81, the cross-cutting device 82 must only be operated once. The known web lengths between the storage device 34 and the cross-cutting device 82 as well as between the third splicing device 72 and the cross-cutting device 82 allow easy operation of the third splicing device 72 and the cross-cutting device 82.

As compared to prior art, the marking device 39 and the detection device 60 have a simple and rigid design; the web length $L_B$ of the temporarily stored web of single-faced corrugated cardboard 2 may thus be determined and the splices 14, 22, 81 may be synchronized in a reliable, precise and easy manner.

The synchronized splices 14, 22, 75 enable all splices 14, 22, 81 to be cut out at once, thus avoiding multiple cutting processes for removing individual splices 14, 22, 81.

The present invention may also be applied in the case of corrugated cardboards comprising more than three webs, such as corrugated cardboards composed of five webs. In that case, two storage devices 34, also referred to as bridges, are provided, each of them storing a certain web length of single-faced corrugated cardboard the precise lengths of which need to be determined. This way, all of the five splices to be produced may substantially be aligned with each other. Due to the high transport speeds, the individual splices may even be spaced apart from each other by for example 1 to 2 m in the above described synchronization. In any case, the described splice synchronization will greatly reduce the amount of rejects that are produced. In particular, rejects are produced, i.e. cut out, only once. The design of the marking device 39, which is characterized in that a solid coloring agent 41 may be applied by rubbing off in order to create a color mark 40, ensures an easy and reliable application of color marks 40. Owing to its simple and robust design, the marking device 39 is a cost-effective and in particular low-maintenance solution as compared to conventional spraying means for applying liquids. The continuous webs of material 13, 21, 81 or webs of corrugated cardboards produced therefrom are not adversely damaged when color marks 40 are applied, as it is the case when spraying on liquids or applying deformation marks by deforming the corrugated cardboards, for example.

The invention claimed is:

1. A corrugating machine for producing corrugated cardboard, comprising a. at least three splicing devices (3, 4, 74) for providing at least three continuous webs of material (13, 21, 65);

b. at least one corrugating device (5) for producing at least one corrugated web (23) from at least one of the webs of material (21);

c. at least one first production device (6) for joining the at least one corrugated web (23) to at least another web of material (13) to form at least one web of single-faced corrugated cardboard (2);

d. at least one second production device (61) for joining the at least one web of single-faced corrugated cardboard (2) to at least another web of material (65) to form at least one web of double-faced corrugated cardboard (66);

e. at least one storage device (34) for temporarily storing the at least one web of single-faced corrugated cardboard (2), the storage device (34) being disposed between the production devices (6, 61);

f. at least one marking device (39) for applying at least one color mark (40) to at least one of the webs (2, 13, 21, 23), the marking device (39) being disposed upstream of the at least one storage device (34) when seen in a transport direction (35), wherein the at least one marking device (39) is designed such that a coloring agent (41) is applicable to create a color mark (40) by rubbing off on at least one of the webs (2, 13, 21, 23), the coloring agent (41) being present in solid form, wherein the at least one marking device (39) comprises a piston-cylinder unit comprising a cylinder (42) and a piston (44) that is displaceable therein along a direction of displacement (43), said piston having a holder with a recess against which said coloring agent abuts, and the holder being located inside the cylinder, and wherein the at least one marking device (39) is disposed relative to one of the webs of material (21) such that the direction of displacement (43) is substantially perpendicular to a plane spanned by said web of material (21) in the vicinity of the at least one marking device;

g. at least one detection device (60) for detecting the at least one color mark (40), the detection device (60) being disposed downstream of the at least one storage device (34) when seen in the transport direction (35);

h. at least one electronic control device (86) for determining a web length (LB) of the at least one temporarily stored web of corrugated cardboard (2) by means of the at least one applied and detected color mark (40);

i. at least one cross-cutting device (82) for cutting the at least one web of double-faced corrugated cardboard (66) in dependence of the determined web length (LB); and j. a support component (55) comprising a roller mounted for rotation disposed relative to the at least one of the webs of material (21) opposite to the marking device.

2. A corrugating machine according to claim 1, wherein the at least one marking device (39) is disposed upstream of the at least one first production device (6) when seen in the transport direction (35).

3. A corrugating machine according to claim 1, wherein the at least one detection device (60) is disposed between the at least one storage device (34) and the at least one second production device (61).

4. A corrugating machine according to claim 1, wherein the at least one detection device (60) has an optical detector (62).

5. A corrugating machine according to claim 1, wherein the holder is joined to the piston (44) so as to be displaceable relative to the support component (55).

6. A corrugating machine according to claim 1, wherein the at least one marking device (39) has at least one return element (52) that is designed such that the piston (44) is automatically returnable.

7. A method of producing corrugated cardboard comprising the steps:

a. providing at least three continuous webs of material (13, 21, 65) by means of at least three splicing devices (3, 4, 74);

b. producing at least one corrugated web (23) from at least one of the webs of material (21) by means of at least one corrugating device (5);

c. joining the at least one corrugated web (23) to at least another web of material (13) to form at least one web of single-faced corrugated cardboard (2) by means of at least one first production device (6);

d. applying at least one color mark (40) to at least one of the webs (2, 12, 21, 23) by means of at least one marking device (39), the at least one color marking (40) being applied by rubbing off a coloring agent (41) which is present in solid form;

e. temporarily storing the at least one marked web of corrugated cardboard (2) by means of at least one storage device (34);

f. detecting the at least one color mark (40) at least after temporary storage by means of at least one detection device (60);

g. determining a web length (LB) of the at least one temporarily stored web of corrugated cardboard (2) by means of the at least one applied and detected color mark (40) in at least one electronic control device (86);

h. joining the at least one web of single-faced corrugated cardboard (2) to at least another web of material (65) to form at least one web of double-faced corrugated cardboard (66) by means of at least one second production device (61);

i. cutting the at least one web of double-faced corrugated cardboard (66) depending on the determined web length (LB) by means of at least one cross-cutting device (82);

j. wherein the at least one marking device (39) is a piston-cylinder unit comprising a cylinder (42) and a piston (44) such that displacing the piston (44) in the cylinder (42) is enabled along a direction of displacement (43), said piston having a holder with a recess against which said coloring agent abuts, and the holder being located inside the cylinder; and k. wherein the at least one marking device (39) is disposed relative to one of the webs of material (21) such that the direction of displacement (43) is substantially perpendicular to a plane spanned by said web of material (21) in the vicinity of the at least one marking device (39); and l. wherein a support component (55) comprising a roller mounted for rotation disposed relative to the at least one of the webs of material (21) opposite to the marking device.

8. A method according to claim 7, wherein the at least one color mark (40) is applied such that this color mark (40) is disposed in an edge area (56) of the at least one web of single-faced corrugated cardboard (2).

9. A method according to claim 7, wherein by means of the at least one control device (86), at least one of the splicing devices (3, 4, 74) is operated depending on the determined web length (LB) such that at least two joining points (14, 22, 81) in at least two of the continuous webs of material (13, 21, 65) are disposed one above the other in a substantially congruent manner in the web of double-faced corrugated cardboard (66).

* * * * *